US009807533B2

(12) United States Patent
Mehnert et al.

(10) Patent No.: US 9,807,533 B2
(45) Date of Patent: Oct. 31, 2017

(54) AUDIO REPRODUCTION SYSTEM AND METHOD FOR REPRODUCING AUDIO DATA OF AT LEAST ONE AUDIO OBJECT

(71) Applicant: Barco NV, Kortrijk (BE)

(72) Inventors: Markus Mehnert, Heringen (DE); Robert Steffens, Baunatal (DE); Marko Döring, Erfurt (DE)

(73) Assignee: Barco NV, Kortrijk (BE)

( * ) Notice: Subject to any disclaimer, the term of this patent is extended or adjusted under 35 U.S.C. 154(b) by 0 days.

(21) Appl. No.: 14/893,738

(22) PCT Filed: May 26, 2014

(86) PCT No.: PCT/EP2014/060814

§ 371 (c)(1),
(2) Date: Nov. 24, 2015

(87) PCT Pub. No.: WO2014/191347

PCT Pub. Date: Dec. 4, 2014

(65) Prior Publication Data

US 2016/0112819 A1 Apr. 21, 2016

(30) Foreign Application Priority Data

May 30, 2013 (EP) ..... 13169944

(51) Int. Cl.
*H04S 3/00* (2006.01)
*H04S 5/00* (2006.01)
(Continued)

(52) U.S. Cl.
CPC ..... *H04S 3/002* (2013.01); *H04S 5/005* (2013.01); *H04R 5/02* (2013.01); *H04S 7/30* (2013.01);
(Continued)

(58) Field of Classification Search
CPC . H04S 3/002; H04S 5/005; H04S 5/02; H04S 7/30
(Continued)

(56) References Cited

U.S. PATENT DOCUMENTS

2012/0314872 A1 12/2012 Tan et al.

FOREIGN PATENT DOCUMENTS

CN 101491116 A 7/2009
EP 1128706 A1 8/2001

OTHER PUBLICATIONS

International Search Report for PCT/EP2014/060814, ISA/EP, Rijswijk, NL, mailed Sep. 8, 2014.
(Continued)

*Primary Examiner* — David Ton
(74) *Attorney, Agent, or Firm* — Harness, Dickey & Pierce, P.L.C.

(57) ABSTRACT

An audio reproduction system for reproducing audio data of at least one audio object and/or at least one sound source of an acoustic scene in a given environment comprising:

at least two audio systems acting distantly apart from each other, wherein one of the audio systems is adapted to reproduce the audio object and/or the sound source in a first distance range to a listener and another of the audio systems is adapted to reproduce the audio object and/or the sound source in a second distance range to the listener, wherein the first and second distance ranges are different and possibly spaced apart from each other or placed adjacent to each other; and a panning information provider adapted to process at least one input to generate at least one panning information for each audio system to drive the at least two audio systems.

9 Claims, 15 Drawing Sheets

(51) Int. Cl.
*H04R 5/02* (2006.01)
*H04S 7/00* (2006.01)

(52) U.S. Cl.
CPC ..... *H04S 2400/11* (2013.01); *H04S 2420/01* (2013.01); *H04S 2420/11* (2013.01); *H04S 2420/13* (2013.01)

(58) Field of Classification Search
USPC ..... 381/17, 18, 303, 310
See application file for complete search history.

(56) References Cited

OTHER PUBLICATIONS

CN Search Report dated Jan. 11, 2017 from corresponding CN application.

AUDIO REPRODUCTION SYSTEM AND METHOD FOR REPRODUCING AUDIO DATA OF AT LEAST ONE AUDIO OBJECT

CROSS-REFERENCE TO RELATED APPLICATIONS

This application is a 371 U.S. National Stage of International Application No. PCT/EP2014/060814, filed May 26, 2014, which claims the benefit of and priority to European Patent Application No. 13169944.9, filed May 30, 2013. The entire disclosures of the above applications are incorporated herein by reference.

TECHNICAL FIELD

The invention relates to an audio reproduction system and method for reproducing audio data of at least one audio object and/or at least one sound source in a given environment.

BACKGROUND OF THE INVENTION

Multi-channel signals may be reproduced by three or more speakers, for example, 5.1 or 7.1 surround sound channel speakers to develop three-dimensional (3D) effects.

Conventional surround sound systems can produce sounds placed nearly in any direction with respect to a listener positioned in the so called sweet spot of the system. However, conventional 5.1 or 7.1 surround sound systems do not allow for reproducing auditory events that the listener perceives in a close distance to his head. Several other spatial audio technologies like Wave Field Synthesis (WFS) or Higher Order Ambisonics (HOA) systems are able to produce so-called focused sources, which can create a proximity effect using a high number of loudspeakers for concentrating acoustic energy at a determinable position relative to the listener.

Channel-based surround sound reproduction and object-based scene rendering are known in the art. Several surround sound systems exist that reproduce audio with a plurality of loudspeakers placed around a so-called sweet spot. The sweet spot is the place where the listener should be positioned to perceive an optimal spatial impression of the audio content. Most conventional systems of this type are regular 5.1 or 7.1 systems with 5 or 7 loudspeakers positioned on a rectangle, circle or sphere around the listener and a low frequency effect channel. The audio signals for feeding the loudspeakers are either created during the production process by a mixer (e.g. motion picture sound track) or they are generated in real-time, e.g. in interactive gaming scenarios.

SUMMARY OF THE INVENTION

It is an object of the present invention to provide an improved audio reproduction system and a method for reproducing audio data of at least one audio object in a given environment to develop multi-dimensional, in particular two- or three-dimensional sound effects.

The object is achieved by an audio reproduction system according to claim 1 and by a method for reproducing audio data of at least one audio object according to claim 7.

Preferred embodiments of the invention are given in the dependent claims.

According to the invention an audio reproduction system for reproducing audio data of at least one audio object and/or at least one sound source of an acoustic scene in a given environment is provided wherein the audio reproduction system comprises:

at least two audio systems acting distantly apart from each other, wherein one of the audio systems is adapted to reproduce audio signals corresponding to the audio object and/or the sound source arranged in at least a first distance range to a listener and another of the audio systems is adapted to reproduce audio signals corresponding to the audio object and/or the sound source arranged in at least a second distance range to the listener, wherein the first and second distance ranges are different and possibly spaced apart from each other or placed adjacent to each other;

a panning information provider adapted to process at least one input to generate at least one panning information for each audio system to drive the at least two audio systems, wherein an input comprises position data of the position of the audio object and/or of the sound source in the acoustic scene, and wherein the panning information comprises at least one parameter, in particular a signal intensity and/or an angular position for the same audio object and/or the same sound source for each audio system to differently drive the at least two audio systems, in particular to differently generate audio signals in such a manner that the same audio object and/or the same sound source is panned within at least one of the distance ranges and/or between the two distance ranges.

The invention allows different extended virtual 2D or 3D sound effects in such a manner that the distance ranges created by the at least one or two audio systems, e.g. a surround system and a proximity audio system, e.g. sound bars, in particular the different distance ranges around the listener are considered for controlling the at least two audio systems for reproducing the virtual or real audio object and/or sound source so that the audio object and/or the sound source is panned between the distance ranges as well as within at least one of the distance ranges. Hence, the invention allows an extended virtual 2D or 3D sound effect in such a manner that a given virtual or real audio object and/or sound source in a space of a virtual or real acoustic scene relative to a position of a listener in the acoustic scene is reproduced with perception of the distance (on a distant or close range or between both ranges and thus any distance between far away and close) and/or the direction (in an angular position to the listener's position and respectively on a left and/or a right channel considering headphone applications, e.g. for sound effects on the left and/or the right ear).

The audio reproduction system may be used in interactive gaming scenarios, movies and/or other PC applications in which multidimensional, in particular 2D or 3D sound effects are desirable. In particular the arrangement allows 2D or 3D sound effects generating in different audio systems, e.g. in a headphone assembly as well as in a surround system and/or in sound bars, which are very close to the listener as well as far away from the listener or any range between. For this purpose, the acoustic environment, e.g. the acoustic scene and/or the environment, is subdivided into a given number of distance ranges, e.g. distant ranges, transfer ranges and close ranges with respect to the position of the listener, wherein the transfer ranges are panning areas between any distant and close range.

For example, in interactive gaming scenarios, windy noises might be generated far away from the listener in at least one given distant range by one of the audio systems with a distant range wherein voices might be generated only in one of the listener's ear or close to the listener's ear in at least one given close range by another audio system with a close range.

In other scenarios, the audio object and/or the sound source move around the listener in the respective distant, transfer and/or close ranges using panning between the different close or far acting audio systems, in particular panning between an audio system acting in or covering a distant range and another audio system acting in or covering a close range, so that the listener gets the impressions that the sound comes from any position in the space.

In an exemplary embodiment the environment and/or the acoustic scene are subdivided into the at least two distance ranges, wherein the shapes of the distance ranges differ from each other or are equal. In particular, each distance range may comprise a round shape. Alternatively, depending on the application, e.g. in a game scenario, the shapes of the distance ranges may differ, e.g. may be an irregular shape or the shape of a room.

In a possible embodiment, the audio reproduction system is a headphone assembly, e.g. a HRTF/BRIR based headphone assembly, which is adapted to form a first audio system creating at least the first distance range and a second audio system creating at least the second distance range, in particular adapted to reproducing audio signals corresponding to the at least first and second distance ranges.

In an alternative embodiment, the audio reproduction system comprises a first audio system which is a proximity audio system, e.g. at least one sound bar, to create at least the first distance range and a second audio system which is a surround system to create at least the second distance range, in particular adapted to reproducing audio signals corresponding to the at least second distance range.

The different audios systems, namely the first and the second audio systems, act commonly in a predefined or given share in such a manner that both audio systems create a transfer range as a third distance range which is a panning area between the first and the second distance range.

In an exemplary embodiment, the proximity audio system is at least one sound bar comprising a plurality of loudspeakers controlled by at least one panning parameter for panning at least one audio object and/or at least one sound source to a respective angular position and with a respective intensity in the close range of the listener for the respective sound bar. In particular, two sound bars are provided wherein one sound bar is directed to the left side of the listener and the other sound bar is directed to the right side of the listener. For a sound source in a space of an acoustic scene coming from the left side of the listener an audio signal for the respective left sound bar is created in particular with more intensity than for the right sound bar. By that difference of intensities the path of the sound waves through the air is considered and natural perception is achieved. The proximity audio system might be designed as a virtual or distally arranged proximity audio system wherein the sound bars of a virtual proximity audio system are simulated by a computer-implemented system in the given environment and the sound bars of a real proximity audio system are arranged in a distance to the listener.

Further, the surround system comprises at least four loudspeakers and might be designed as a virtual or spatially arranged audio system, e.g. a home entertainment system such as a 5.1 or 7.1 surround system.

The combination of the different audio systems creating or covering different distance ranges allows to generate multidimensional, e.g. 3D sound effects in different scenarios wherein sound sources and/or audio objects far away from the listener are generated by the surround system in one of the distant ranges and sound sources and/or audio objects close to the listener are generated in one of the close ranges by the headphone assembly and/or the proximity audio system. Using panning information allows that a movement of the audio objects and/or the sound sources in the acoustic environment in a transfer range between the different close and distant ranges results in a changing listening perception of the distance to the listener and also results in a respective driving of the proximity audio system, e.g. a headphone assembly as well as the basic audio system, e.g. a surround system. The surround system might be designed as a virtual or spatially or distantly arranged surround system wherein the virtual surround system is simulated in the given environment by a computer-implemented system and the real surround system is arranged in a distance to the listener in the given environment.

According to another aspect of the invention, another input comprises metadata of the acoustic scene, the environment, the audio object, the sound source and/or an effect slider. Additionally or alternatively, that metadata may more precisely be described for instance by distance range data, audio object data, sound source data, position data, random position area data and/or motion path data and/or effect data, time data, event data and/or group data. The use of metadata describing the environment, the acoustic scene, the distance ranges, the random position area/s, the motion path, the audio object and/or the sound source allows extracting or generating of parameters of the panning information for the at least two audio systems depending on the distance of the audio object to the listener and thus allows panning by generating at least one panning information for each audio system calculated on the basis of at least the position of the audio object/sound source relative to the listener. In particular, the panning information may be predefined e.g. as a relationship of the audio object/sound source and the listener, of the audio object/sound source and the environment and/or of the audio object/sound source and the acoustic scene. Additionally or alternatively, the panning information may be predefined by further characterizing data, in particular the distance range data, the motion path data, the effect slider data, the random position area data, time data, event data, group data and further available data/definitions.

According to another aspect of the invention, a method for reproducing audio signals corresponding to audio data of at least one audio object and/or at least one sound source in an acoustic scene in a given environment by at least two audio systems acting distantly apart from each other is provided, wherein the method comprises the following steps:

one of the audio systems reproduces audio signals corresponding to the audio object and/or the sound source arranged in at least one first distance range to a listener and another of the audio systems reproduces audio signals corresponding to the audio object and/or the sound source arranged in at least one second distance range to the listener, wherein the first and second distance ranges are different and possibly spaced apart from each other or placed adjacent to each other;

a panning information provider processes at least one input to generate at least one panning information for each audio system to differently drive the at least two audio systems, in particular to differently generate audio signals, wherein as an input a position data of the position of the audio object and/or of the sound source in the environment are provided, and wherein as the panning information at least one parameter, in particular a signal intensity and/or an angular position for the same audio object and/or the same sound source is generated for each audio system to differently drive the at least two audio systems, in particular to differently generate audio signals in such a manner that the same audio object and/or the same sound source is panned within at least one distance range (close range, transfer range, distant range).

In an exemplary embodiment, the angular position of the same audio object and/or the same sound source for the at least two audio systems are equal so that it seems that the audio object and/or the sound source is reproduced in the same direction. Alternatively, to achieve specific sound effects, e.g. double reproduction, the angular position of the same audio object and/or sound source may differ for the different audio systems so that the audio object and/or the sound source is reproduced by the different audio systems in different directions.

To achieve temporal, local and/or spatial sound effects for the audio object and/or the sound source in the environment and/or in the acoustic scene, e.g. in a game scenario, the panning information is determined by at least one given distance effect function which represents the reproducing sound of the respective audio object and/or the respective sound source by controlling the audio systems with determined respective effect intensities depending on the distance.

According to another aspect of the invention, as another input metadata of the acoustic scene, of the environment, the audio object, the sound source and/or the effect slider are provided, e.g. for an automatic blending of the audio object and/or the sound source between the at least two audio systems depending on the distance of the audio object/sound source to the listener and thus for an automatic panning by generating at least one predefined panning information for each audio system calculated on the base of the position of the audio object/sound source relative to the listener.

To achieve further special sound effects, the panning information, in particular at least one parameter as e.g. the signal intensity and/or the angular position of the same audio object and/or the same sound source for the at least two audio systems, are extracted from the metadata and/or the configuration settings of the audio systems. In particular, the panning information is extracted from the metadata of the respective audio object, e.g. kind of the object and/or the source, relevance of the audio object/the sound source in the environment, e.g. in a game scenario, and/or a time and/or a spot in the environment, in particular a spot in a game scenario or in a room.

Furthermore, the number and/or dimensions of the audio ranges, e.g. of distant (outer), close (inner) and/or transfer ranges (intermediate) are extracted from the configuration settings and/or from the metadata of the acoustic scene and/or the audio object/sound source, in particular from more precisely describing distance range data, to achieve a plurality of spatial and/or local sound effects depending on the number of used audio systems and/or the kind of used acoustic scene.

According to another aspect of the invention, a computer-readable recording medium having a computer program for executing the method described above.

Furthermore, the above described arrangement is used to execute the method for reproducing audio data corresponding to interactive gaming scenarios, software scenarios, theatre scenarios, music scenarios, concert scenarios or movie scenarios.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention.

Corresponding parts are marked with the same reference symbols in all figures.

DETAILED DESCRIPTION OF PREFERRED EMBODIMENTS

Figure 1:
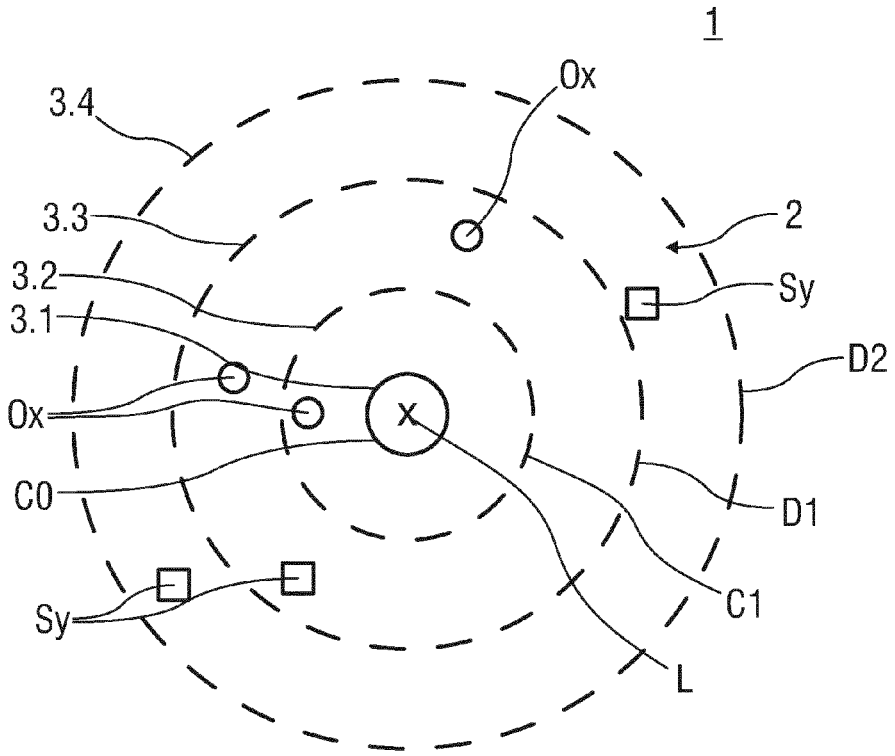
FIG. 1 shows an environment of an acoustic scene comprising different distant and close ranges around a position of a listener.

FIG. 1 shows an exemplary environment 1 of an acoustic scene 2 comprising different distance ranges, in particular distant ranges D1 to Dn and close ranges C0 to Cm around a position X of a listener L.

The environment 1 may be a real or virtual space, e.g. a living room or a space in a game or in a movie or in a software scenario or in a plant or facility. The acoustic scene 2 may be a real or virtual scene, e.g. an audio object Ox, a sound source Sy, a game scene, a movie scene, a technical process, in the environment 1.

The acoustic scene 2 comprises at least one audio object Ox, e.g., voices of persons, wind, noises of audio objects, generated in the virtual environment 1. Additionally or alternatively, the acoustic scene 2 comprises at least one sound source Sy, e.g. loudspeakers, generated in the environment 1. In other words: the acoustic scene 2 is created by the audio reproduction of the at least one audio object Ox and/or the sound source Sy in the respective audio ranges C0 to C1 and D1 to D2 in the environment 1.

Depending on the kind and/or the number of available audio systems 3.1 to 3.4 at least one audio system 3.1 to 3.4 is assigned to one of the distance ranges C0 to C1 and D1 to D2 to create sound effects in the respective distance ranges C0 to C1 and D1 to D2, in particular to reproduce the at least one audio object Ox and/or the sound source Sy in the at least one distance ranges C0 to C1, D1 to D2.

For instance, a first audio system 3.1 is assigned to a first close range C0, a second audio system 3.2 is assigned to a second close range C1, a third audio system 3.3 is assigned to a first distant range D1 and a fourth audio system 3.4 is assigned to a second distant range D2 wherein all ranges C0, C1, D1 and D2 are placed adjacent to each other.

Figure 2:
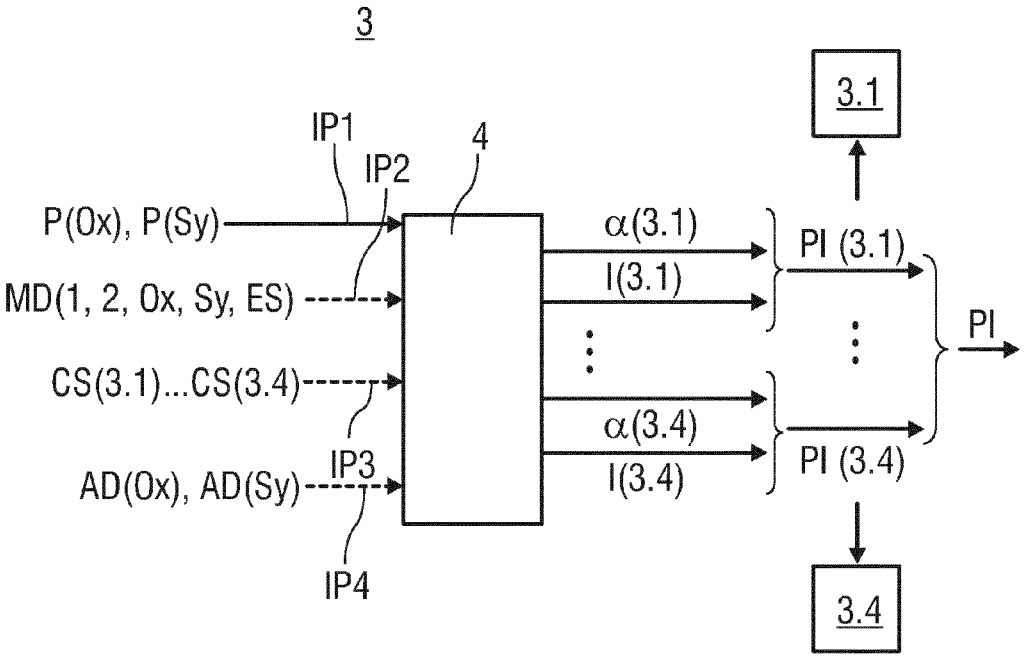
FIG. 2 shows an exemplary embodiment of an audio reproduction system with a panning information provider.

FIG. 2 shows an exemplary embodiment of an audio reproduction system 3 comprising a plurality of audio systems 3.1 to 3.4 and a panning information provider 4.

The audio systems 3.1 to 3.4 are designed as audio systems which create sound effects of an audio object Ox and/or a sound source Sy in close as well as in distant ranges C0 to C1, D1 to D2 of the environment 1 of the listener L. The audio systems 3.1 to 3.4 may be a virtual or real surround system, a headphone assembly, a proximity audio system, e.g. sound bars.

The panning information provider 4 processes at least one input IP1 to IP4 to generate at least one parameter of at least one panning information PI, PI(3.1) to PI(3.4) for each audio system 3.1 to 3.4 to differently drive the audio systems 3.1 to 3.4. One possible parameter of panning information PI is an angular position $\alpha$ of the audio object Ox and/or the sound source Sy. Another parameter of panning information PI is an intensity I of the audio object Ox and/or the sound source Sy.

In a simple embodiment, the audio reproduction system 3 comprises only two audio systems 3.1 to 3.2 which are adapted to commonly interact to create the acoustic scene 2.

As an input IP1 a position data P(Ox), P(Sy) of the position of the audio object Ox and/or of the sound source Sy, e.g. their distance and angular position relative to the listener L in the environment 1, are provided.

Additionally, as another input IP2, basic metadata, in particular metadata MD(1, 2, Ox, Sy, ES) of the acoustic scene 2, the environment 1, the audio object Ox, the sound source Sy and/or the effect slider ES are provided.

Furthermore, the metadata MD(Ox, Sy) of the audio object Ox and/or the sound source Sy may be more precisely described by other data, e.g. the distance ranges C0 to C1, T1, D1 to D2 may be defined as distance range data DRD or distance effect functions, a motion path MP may be defined as motion path data MPD, a random position area A to B may be defined by random position area data and/or effects, time, events, groups may be defined by parameter and/or functions.

Additionally, as another input IP3 configuration settings CS of the audio reproduction system 3, in particular of the audio systems 3.1 to 3.4, e g kind of the audio systems, e.g. virtual or real, number and/or position of the loudspeakers of the audio systems, e.g. position of the loudspeakers relative to the listener L, are provided.

Moreover, as another input IP4 audio data AD(Ox), AD(Sy) of the audio object Ox and/or of the sound source Sy, are provided.

The panning information provider 4 processes the input data of at least one of the above described inputs IP1 to IP4 to generate as panning information PI, PI(3.1 to 3.4) at least one parameter, in particular a signal intensity I(3.1 to 3.4, Ox, Sy) and/or an angular position $\alpha$(3.1 to 3.4, Ox, Sy) of the same audio object Ox and/or the same sound source Sy for each audio system 3.1 to 3.4 to differently drive that audio systems 3.1 to 3.4 in such a manner that the same audio object Ox and/or the same sound source Sy is panned in the acoustic scene 2 between the inner border of the inner audio range C0 and the outer border of the outer audio range D2 within the respective audio ranges C0 to C1, D1 to D2 of the audio systems 3.1 to 3.4.

Figure 3:
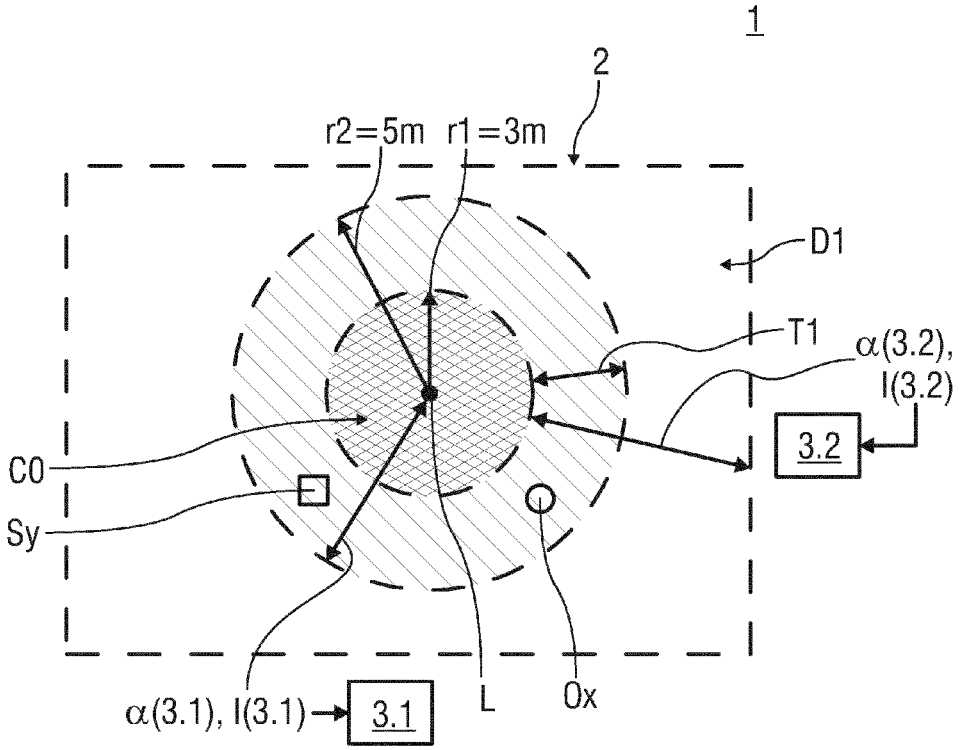
FIG. 3 shows a possible environment of an acoustic scene comprising different distance ranges, namely distant, close and/or transfer ranges around a position of a listener.

In particular, at least one of the audio systems 3.1 reproduces the audio object Ox and/or the sound source Sy in at least one first close range C0 to a listener L and another of the audio systems 3.2 reproduces the audio object Ox and/or the sound source Sy in at least one second distant range D1 to the listener (L). In the case that both audio systems 3.1 and 3.2 reproduce the same audio object Ox and/or the same sound source Sy than that audio object Ox and/or the sound source Sy is panned in a transfer range T1 between the close range C0 and the distant range D1 as it is shown in FIG. 3.

Preferably, the angular position $\alpha$(3.1 to 3.4, Ox, Sy) of the same audio object Ox and/or the same sound source Sy for the audio systems 3.1 to 3.4 are equal to achieve the sound effect that it seems that that audio object Ox and/or that sound source Sy pans in the same direction. Alternatively, the angular position $\alpha$(3.1 to 3.4, Ox, Sy) may be different to achieve special sound effects.

In a further embodiment, the parameter of the panning information PI, in particular the signal intensity I of the same audio object Ox and/or the same sound source Sy for the two audio systems 3.1 to 3.4 are extracted from metadata MD and/or the configuration settings CS of the audio systems 3.1 to 3.4.

The panning information provider 4 is a computer-readable recording medium having a computer program for executing the method described above. The audio reproduction system 3 in combination with the panning information provider 4 may be used for executing the described method in interactive gaming scenarios, software scenarios or movie scenarios and/or other scenarios, e.g. process monitoring scenarios, manufacturing scenarios.

FIG. 3 shows an embodiment of a created acoustic scene 2 in an environment 1 with three distance ranges C0, T1 and D1 created by only two audio systems 3.1 and 3.2, in particular by their conjunction or commonly interacting. The first close range C0 is created by the first audio system 3.1 in a close distance r1 to the listener L and the first distant range D1 is created by a second audio system 3.2 in a distance greater than the far distance r2 to the listener L. The first close range C0 and the first distant range D1 are spaced apart from each other so that a transfer range T1 is arranged between them.

The panning of the audio object Ox and/or the sound source Sy within the transfer range T1 and thus between the close range C0 and the distant range D1 is created by both audio systems 3.1 and 3.2. In particular, each audio system 3.1 and 3.2 is controlled by the extracted parameters of the panning information PI(3.1, 3.2), in particular a given angular position $\alpha$(3.1, Ox, Sy), $\alpha$(3.2, Ox, Sy) and a given intensity I(3.1, Ox, Sy), I(3.2, Ox, Sy), of the same audio object Ox or the same sound source Sy to respectively reproduce the same audio object Ox or the same sound source Sy in such a manner that it sounds that this audio object Ox or this sound source Sy is in a respective direction and in a respective distance within the transfer range T1 to the position X of the listener L.

Figure 4:
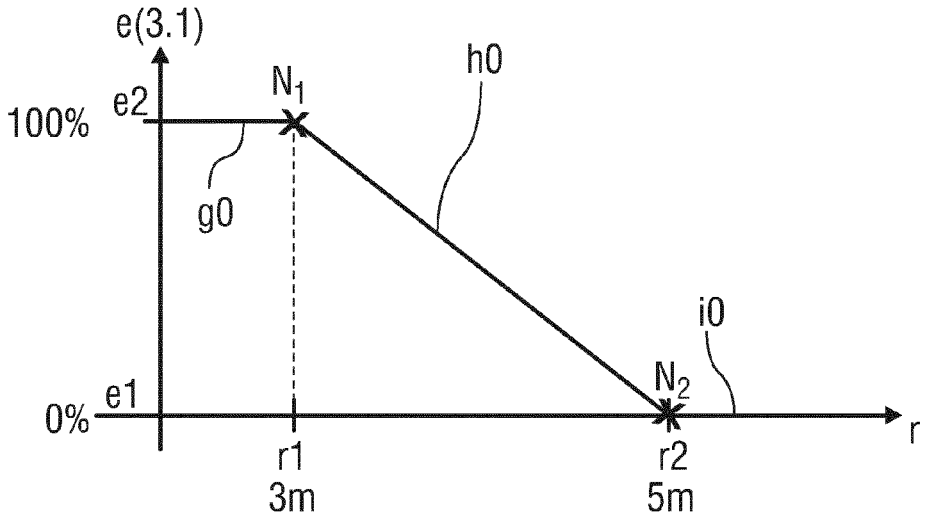
FIG. 4 shows an exemplary embodiment of different distance effect functions for the different distance ranges, namely for the distant, transfer and close ranges.
Figure 4:
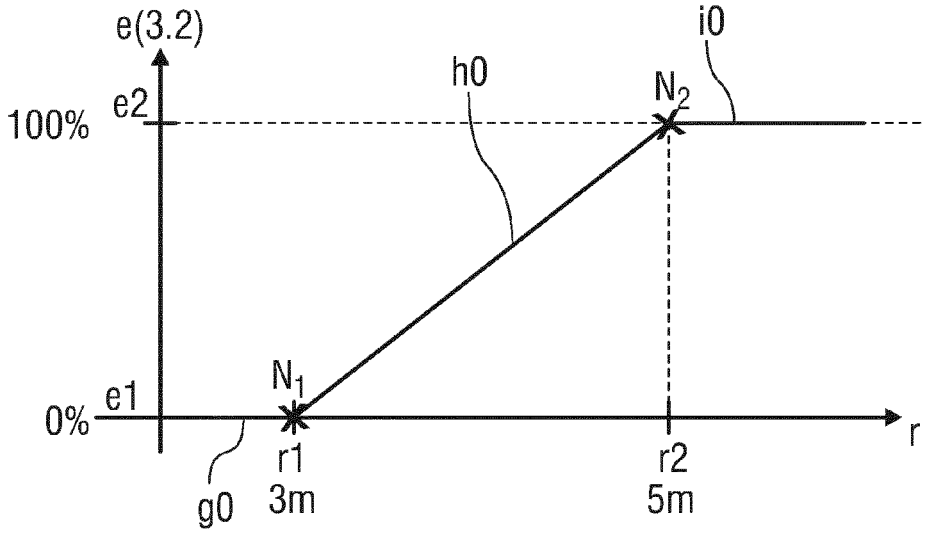

FIG. 4 shows the exemplary embodiment for extracting at least one of the parameters of the panning information PI, namely distance effect functions e(3.1) and e(3.2) for the respective audio object Ox and/or the sound source Sy to control the respective audio systems 3.1 and 3.2 for creating the acoustic scene 2 of FIG. 3.

As the intensities I(3.1, 3.2) the distance effect functions e(3.1, 3.2) are subdivided by other given distance effect functions g0, h0, i0 used to control the respective audio systems 3.1 and 3.2 for creating the distance ranges C0, T1 and D1.

Alternatively, the distance effect functions e may be prioritized or adapted to ensure special sound effects at least in the transfer range T1, wherein the audio systems 3.1 to 3.2 will be alternatively or additionally controlled by the distance effect functions e(3.1) and e(3.2) to create at least the transfer zone T1 as it is shown in FIG. 3.

In the shown embodiment, the panning information PI, namely the distance effect functions e(3.1) and e(3.2) are extracted or determined from given or predefined distance effect functions g0, h0 and i0 depending on the distances r of the reproducing audio object Ox/the sound source Sy to the listener L for panning that audio object Ox and/or that sound source Sy at least in one of the audio ranges C0, T1 and/or D1.

In particular, according to the extracted panning information PI, namely the distance effect functions e(3.1) and e(3.2), the sound effects of the audio object Ox and/or the sound source Sy are respectively reproduced by the first audio system 3.1 and/or second audio system 3.2 at least in a given distance r to the position X of the listener L within at least one of the distance ranges C0, T1 and/or D1 and with a respective intensity I corresponding to the extracted distance effect functions e(3.1) and e(3.2).

As it is shown in FIG. 4, according to the position and thus to the distance r of the audio object Ox and/or the sound source Sy to the position X of the listener L, the distance effect functions e(3.1) and e(3.2) used to control the available audio systems 3.1 and 3.2 may be extracted by given or predefined distance effect functions g0, h0 and i0 for an automatic panning of the audio object Ox/sound source Sy in such a manner that

- for an audio object Ox and/or a sound source Sy moving between a distance from r1=3 m to r2=5 m the distance effect functions e(3.1) and e(3.2) will be extracted from the predefined distance effect function h0(3.1, 3.2),
- for an object in a distance less than r1=3 m the distance effect functions e(3.1) and e(3.2) will be extracted from the predefined distance effect functions g0(3.1, 3.2) (with g0(3.1)=100% for the effect intensity e(3.1) for a proximity audio system 3.1 whereas the effect intensity e(3.2) of a basic audio system 3.2 is g0(3.2)=0%) and
- for an object in a distance greater than r2=5 m the distance effect functions e(3.1) and e(3.2) will be extracted from the predefined functions i0(3.1, 3.2) (with i0(3.1)=0% for the effect intensity e(3.1) of a proximity audio system 3.1 whereas the effect intensity e(3.2) of a basic audio system 3.2 is i0(3.2)=100%).

In this embodiment the conjunction of the at least both audio systems 3.1, 3.2 create all audio ranges C0, T1, D1 according to the effect intensities e extracted from the distance effect functions g0, h0 and i0.

In particular, for the same audio object Ox and/or the same sound source Sy

- in a distance r of up to r1=3 m from the listener L the audio system 3.1 creating the proximity area will be driven by the linear function g0(3.1) with a constant effect intensity e(3.1)=g0(3.1)=e2 of 100% and the audio system 3.2 creating the distant area will be driven by the linear function g0(3.2), with a constant effect intensity e(3.2)=g0(3.2)=e1 of 0%,
- in an area between the distance r1 and the distance r2 and thus between 3 m and 5 m from the listener L the audio system 3.1 creating the proximity area will be driven preferably also by a linear distance effect function h0(3.1) with a monotone decreasing effect intensity e(3.1, r1)=h0(3.1, r1)=e2 of 100% to e(3.1, r2)=h0(3.1, r2)=e1 of 0% and the audio system 3.2 creating the distant area will be driven by the linear distance effect function h0(3.2), with a monotone increasing effect intensity e(3.2, r1)=h0(3.2, r1)=e1 of 0% to e(3.2, r2)=h0(3.2, r2)=e2 of 100%, alternatively the distance effect functions e(3.1) to e(3.2) may be extracted from nonlinear functions h1 to hx in the same manner,
- in a distance r greater than r2=5 m from the listener L the audio system 3.1 creating the proximity area will be driven by the linear distance effect function i0(3.1) with a constant effect intensity e(3.1)=i0(3.1)=e1 of 0% and the audio system 3.2 creating the distant area will be driven by the linear distance effect function i0(3.2), with a constant effect intensity e(3.2)=i0(3.2)=e2 of 100%.

Figure 5:
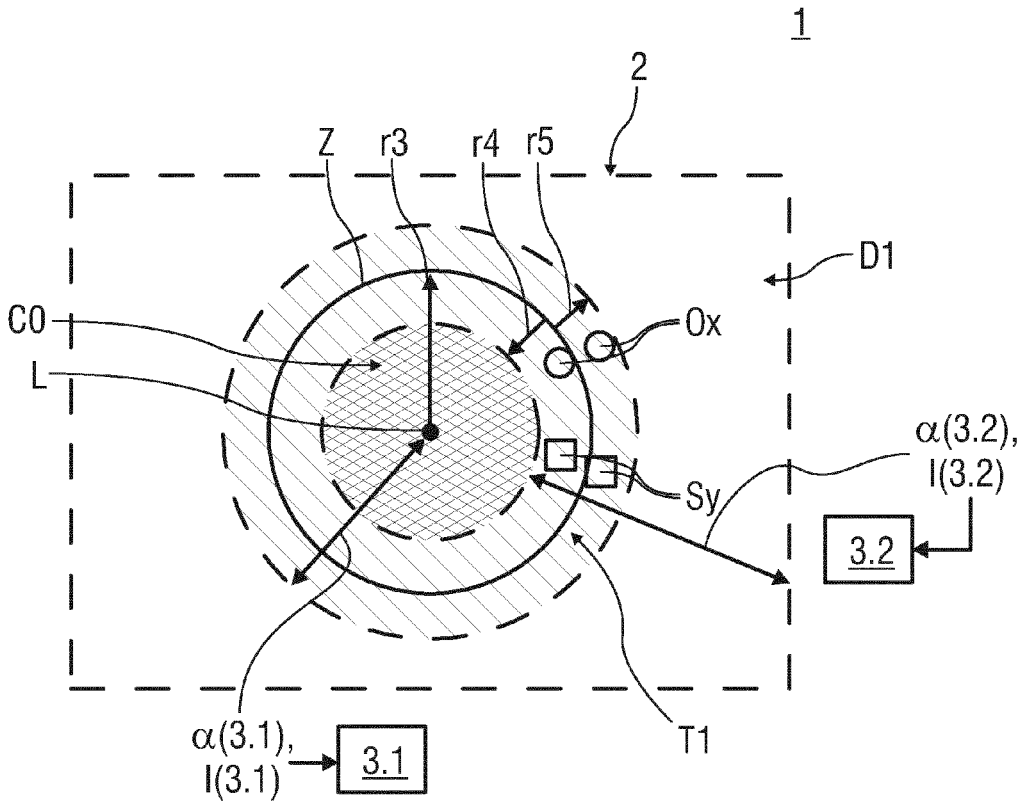
FIGS. 5 to 6 show other possible environments of an acoustic scene comprising different distant, transfer and close ranges around a position of a listener.
Figure 6:
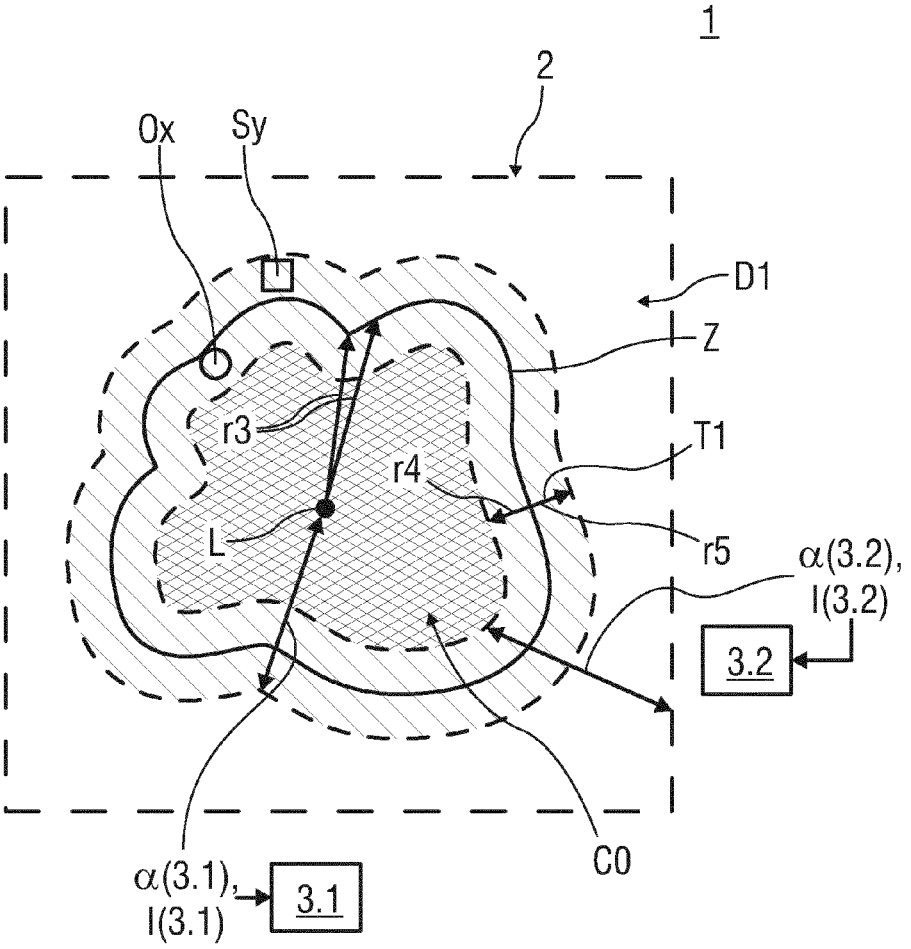

FIGS. 5 to 6 show other possible environments 1 of an acoustic scene 2.

FIG. 5 shows a further environment 1 with three distance ranges C0, T1 and D1 created by two audio systems 3.1 and 3.2 wherein the transfer range T1 is arranged between a distant range D1 and a close range C0 created by the conjunction of both audio systems 3.1 and 3.2. In other words: The panning of the audio object Ox and/or the sound source Sy within the transfer range T1 and thus between the close range C0 and the distant range D1 is created by both audio systems 3.1 and 3.2.

The transfer range T1 is subdivided by a circumferential structure Z which is in a given distance r3 to the listener L. Further distances r4 and r5 are determined, wherein the distance r4 represents the distance from the circumferential structure Z to the outer surface of the close range C0 and the distance r5 represents the distance from the circumferential structure Z to the inner surface of the distant range D1.

In particular, the audio system 3.1 in conjunction with the audio system 3.2 is controlled by at least one parameter of the panning information PI, in particular a given angular position α(3.1) and/or a given intensity I(3.1), of the audio object Ox or the sound source Sy which is respectively reproduced and panned in such a manner that it seems that this audio object Ox(r4, r5) or this sound source Sy(r4, r5) is in a respective direction and in a respective distances r4, r5 within the transfer range T1 to the position X of the listener L.

Additionally, the audio system 3.2 in conjunction with the audio system 3.1 is controlled by at least another parameter of the panning information PI, in particular a given angular position α(3.2) and/or a given intensity I(3.2), of the audio object Ox or the sound source Sy which is respectively reproduced and panned in such a manner that it seems that this audio object Ox (r4, r5) or this sound source Sy(r4, r5)

is in a respective direction and in a respective distances r4, r5 within the transfer range T1 to the position X of the listener L.

FIG. 6 shows a further environment 1 with three distance ranges C0, T1 and D1 created by the only two audio systems 3.1 and 3.2 wherein a transfer range T1 is arranged between a distant range D1 and a close range C0.

The outer and/or the inner circumferential shapes of the ranges C0 and D1 are irregular and thus differ from each other. The panning of the audio object Ox and/or the sound source Sy within the transfer range T1 and thus between the close range C0 and the distant range D1 is created by both audio systems 3.1 and 3.2 analogous to the embodiment of FIGS. 3 and 5.

Figure 7:
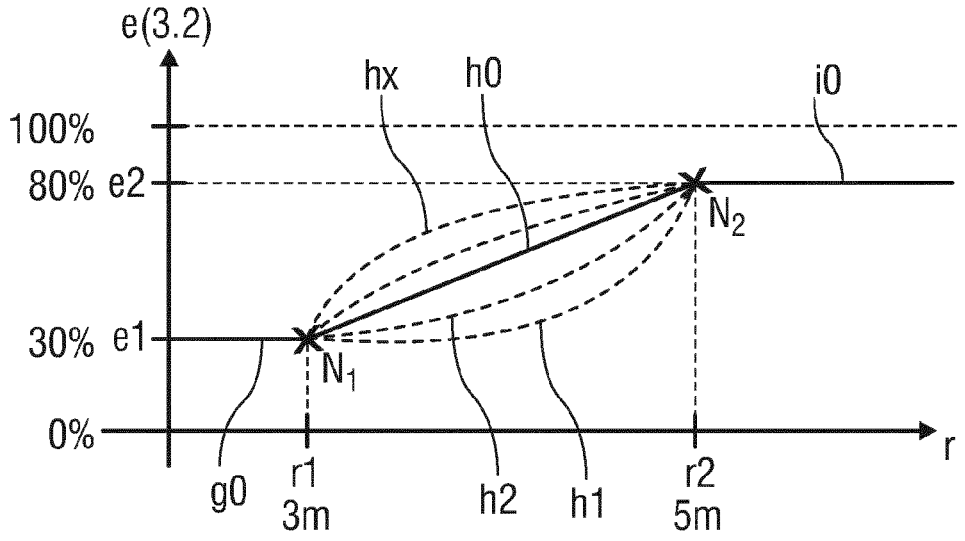
FIG. 7 shows an exemplary embodiment of different distance effect functions for the distant and close ranges and for the transfer ranges.

FIG. 7 shows an alternative exemplary embodiment for extracting panning information PI, namely distance effect function e(3.2) for the respective audio object Ox and/or the sound source Sy to drive the respective audio system 3.2 wherein the conjunction of the at least both audio systems 3.1 to 3.2 creates all audio ranges C0, T1 and D1.

According to the position and thus to the distance r1, r2 of the audio object Ox and/or the sound source Sy to the position X of the listener L, the distance effect functions e used to control the available audio systems 3.1 and 3.2 may be extracted by other given or predefined linear and/or non-linear distance effect functions g0, h0 to hx and i0 for an automatic panning of the audio object Ox/sound source Sy in such a manner that for an audio object Ox/a sound source Sy moving between a distance from 3 m to 5 m the distance effect functions e will be extracted from one of the predefined linear and/or non-linear distance effect functions h0 to hx, for an object in a distance less than 3 m the distance effect functions e will be extracted from the predefined distance effect functions g0 and for an object in a distance greater than 5 m the distance effect functions e will be extracted from the predefined distance effect functions i0.

In this embodiment the conjunction of the at least both audio systems 3.1, 3.2 create all distance ranges C0, T1, D1 according to the effect intensities e extracted from the distance effect functions g0, h0 to hx and i0.

Generally, the sum of the distance effect functions e(3.1) to e(3.*n*) is 100%. For instance, in the case that the audio reproduction system 3 comprises two audio systems 3.1, 3.2 then two distance effect functions e(3.1) and e(3.2) are provided as follows:

$$e(3.1)+e(3.2)=100\% \quad [0]$$

In this embodiment, only one distance effect function for example e(3.2) may be provided as the other distance effect function e(3.1) may be extracted from the only one.

In particular, for the same audio object Ox and/or the same sound source Sy in a distance r of up to r1=3 m from the listener L the audio system 3.1 creating the proximity area will be driven by the linear distance effect function g0(3.1) with a constant effect intensity e(3.1)=1-g0(3.2)=1-e1 of 70% and the audio system 3.2 creating the distant area will be driven by the linear distance effect function g0(3.2), with a constant effect intensity e(3.2)=g0(3.2)=e1 of 30%, in an area between the distance r1 and the distance r2 and thus between 3 m and 5 m from the listener L the audio system 3.1 creating the proximity area will be driven preferably also by a linear distance effect function h0(3.1) with a monotone decreasing effect intensity e(3.1, r1)=1-e(3.2, r1)=1-e1 of 70% to e(3.1, r2)=1-e(3.2, r2)=1-e2 of 20% and the audio system 3.2 creating the distant area will be driven by the linear distance effect function h0(3.2), with a monotone increasing effect intensity e(3.2, r1)=h0(3.2, r1)=e1 of 30% to e(3.2, r2)=h0(3.2, r2)=e2 of 80%, alternatively the effect intensities e(3.1) to e(3.2) may be extracted from nonlinear functions h1 to hx in the same manner (alternatively, non-linear distance effect functions h1 to hx may be also used in a similar manner to achieve special sound effects in the panning area), in a distance r greater than r2=5 m from the listener L the audio system 3.1 creating the proximity area will be driven by the linear distance effect function i0(3.1) with a constant effect intensity e(3.1)=1-i0(3.2)=1-e2 of 20% and the audio system 3.2 creating the distant area will be driven by the linear distance effect function i0(3.2), with a constant effect intensity e(3.2)=i0(3.2)=e2 of 80%.

Figure 8:
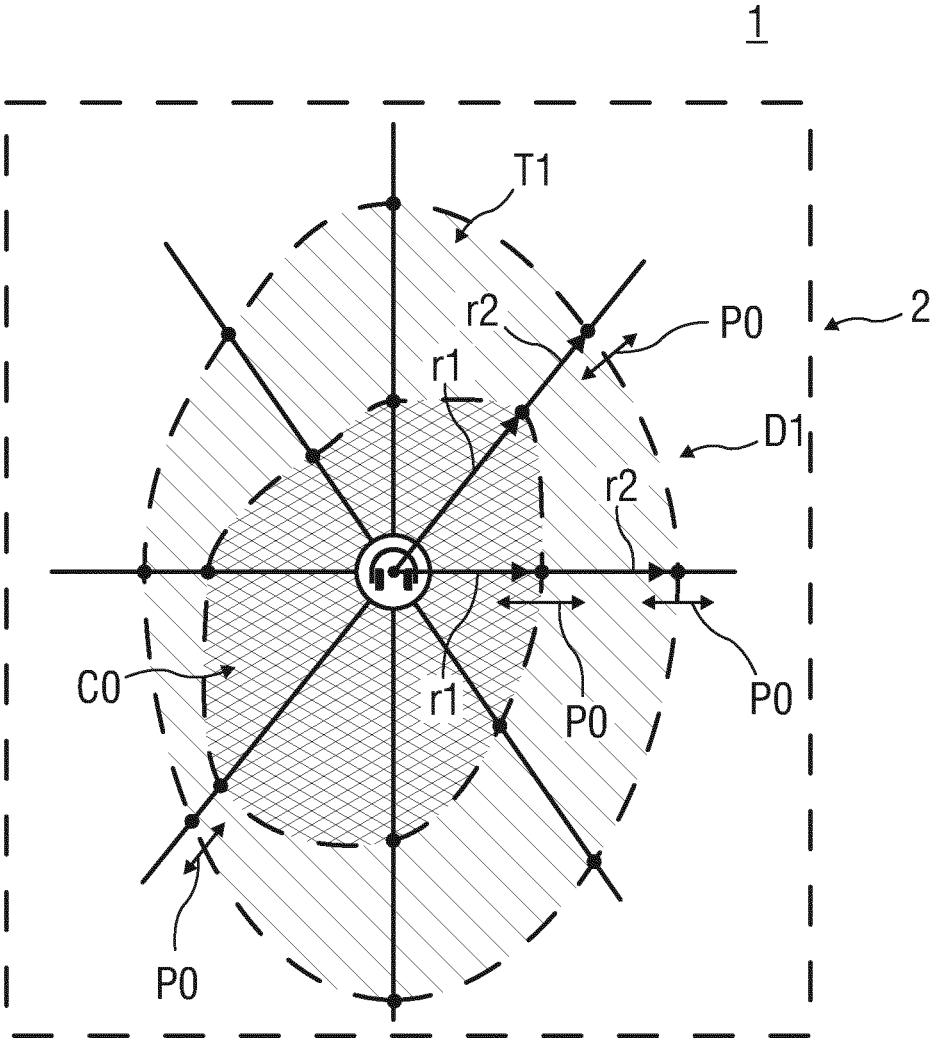
FIGS. 8 to 10 show exemplary embodiments of different acoustic scenes comprising different and possible variable distance ranges, namely distant, transfer and close ranges around a position of a listener.
Figure 9:
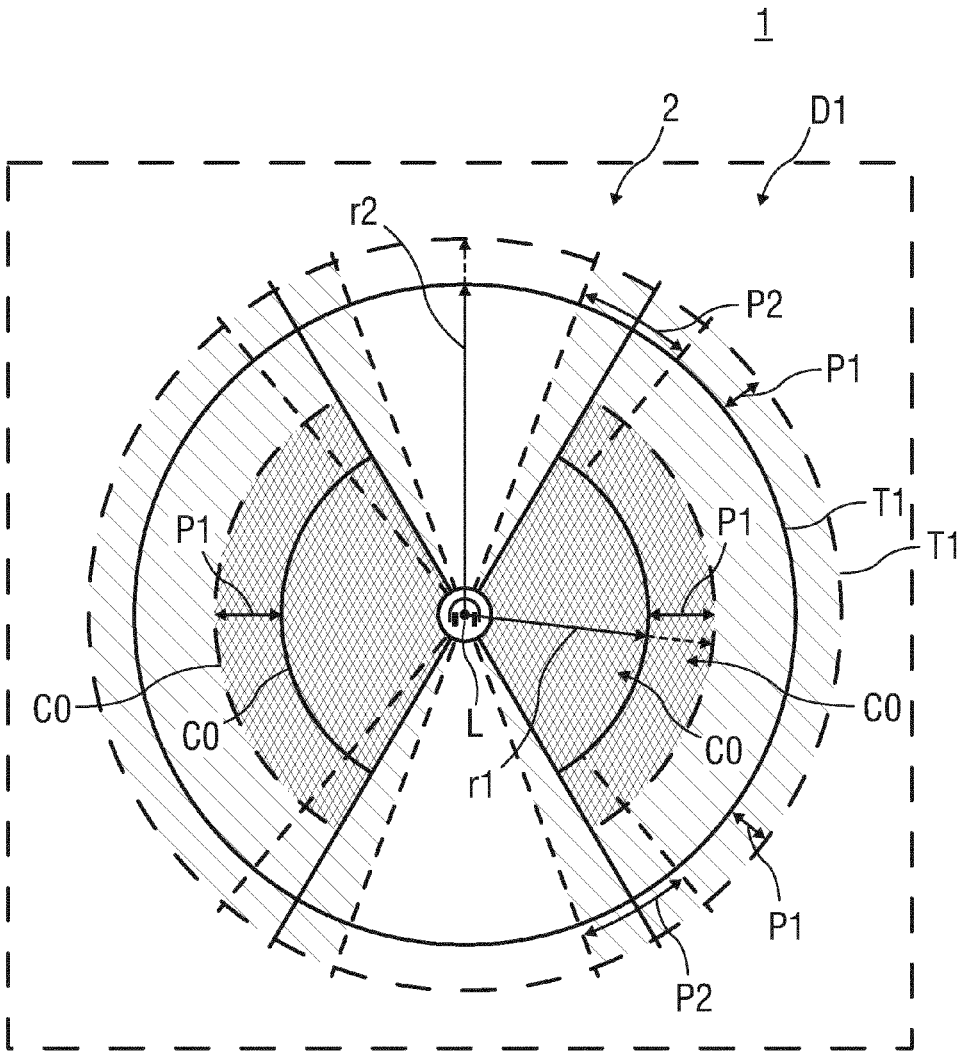
Figure 10:
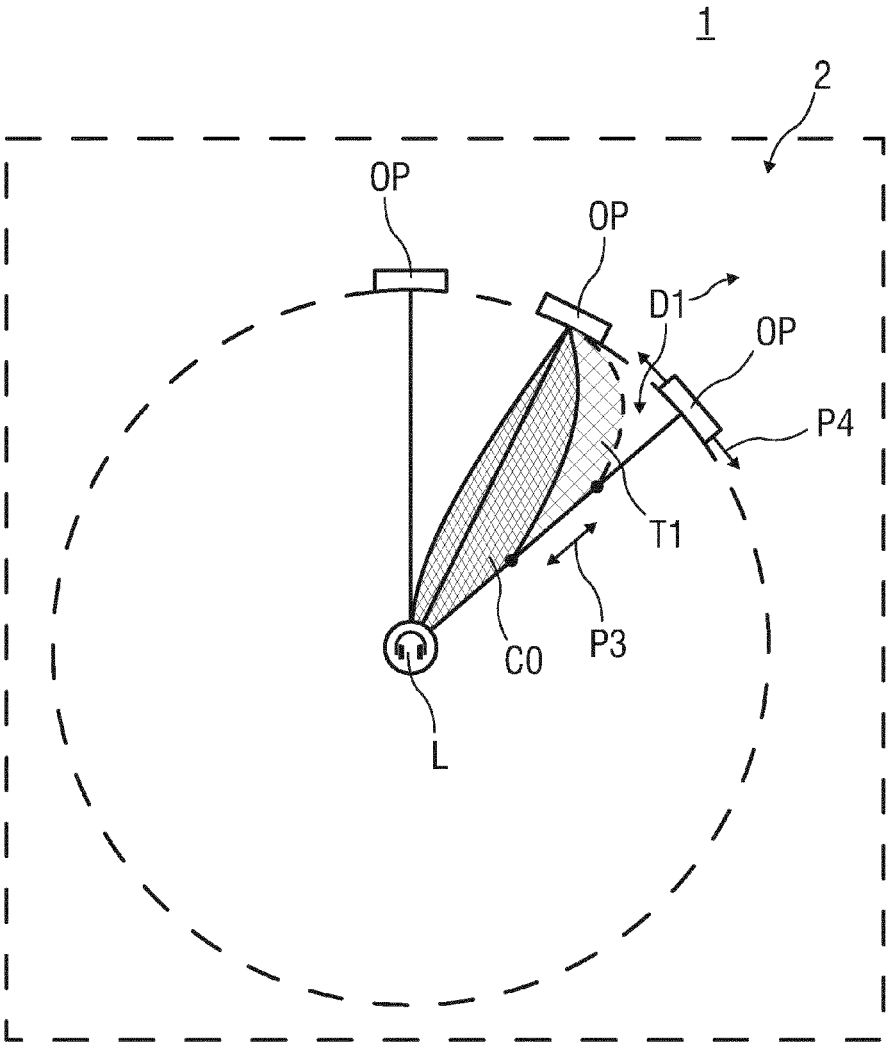

FIGS. 8 to 10 show exemplary embodiments of further different acoustic scenes 2 comprising different and possible variable distant and close ranges C0, D1 and/or transfer ranges T1 around a position X of a listener L.

FIG. 8 shows an example for amending the distance ranges C0, T1, D1, in particular radially amending the outer distance r1, r2 of the close range C0 and the transfer range T1 and thus amending the transfer or panning area by amending the distances r1, r2 according to arrows P0. In other words: As a result of amending the distances r1, r2 of the distance ranges C0, T1 special close or far distance effects may be achieved.

FIG. 9 shows another example, in particular an extension for amending the distance ranges C0, T1, D1, in particular the close range C0 and the transfer range T1 by amending the distances r1, r2 according to arrows P1 and/or amending the angles α according to arrows P2.

Figure 11:
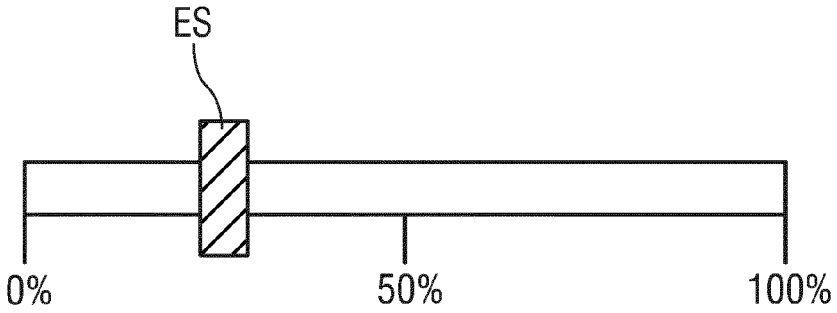
FIG. 11 shows an exemplary embodiment of an effect slider.

For example the acoustic scene 2 may be amended by adapting functions of a number of effect sliders ES shown in FIG. 11.

In one possible embodiment the distances r1, r2 of the distance ranges C0 and D1 and thus the inner and outer distances of the transfer range T1 may be slidable according to arrows P1.

According to this embodiment, the close range C0 and the transfer range T1 do not describe a circle. On the contrary, the close range C0 and the transfer range T1 are designed as circular segment around the ear area of the listener L wherein the circular segment is also changeable. In particular the angle of the circular segment may be amended by a sliding of a respective effect slider ES or another control function according to arrows P2.

In other words: The transfer zone or area between the two distance ranges C0 and D1 may be adapted by an adapting function, in particular a further scaling factor for the radius of the distance ranges C0, T1, D1 and/or the angle of circular segments.

FIG. 10 shows a further embodiment with a so-called spread widget tool function for a free amending of at least one of the distance ranges C0, T1, D1.

In particular, an operator OP or a programmable operator function controlling an area from 0° to 360° may be used to freely amend the transfer range T1 in such a manner that a position of the angle leg of the transfer range T1 may be moved, in particular rotated to achieve arbitrary distance ranges C0, T1, D1, in particular close range C0 and transfer range T1 as it is shown in FIG. 10.

FIG. 11 shows an exemplary embodiment of an effect slider ES e.g. used by a soundman or a monitoring person.

The effect slider ES enables an adapting function, in particular a scaling factor f for adapting parameter of the panning information PI. For example, the effect slider ES may be designed for amending basic definitions such as an audio object Ox, a sound source Sy and/or a group of them. Furthermore, other definitions, in particular distances r, intensities I, the time, metadata MD, motion path data MPD, distance range data DRD, distance effect functions e(3.1 to 3.*n*), circumferential structure Z, position data P etc may be also amended by another effect slider ES to respectively drive the audio systems 3.1, 3.2.

For example, the effect slider ES enables an additional assignment of a time, a position, a drama and/or other properties and/or events and/or states to at least one audio object Ox and/or sound source Sy and/or to a group of audio objects Ox and/or sound sources Sy by setting of the respective effect slider ES to adapt at least one of the parameters of the panning information, e.g. the distance effect functions e, the intensities I and/or the angles α.

In a possible embodiment, the scaling factor f may be used for adapting the distance effect functions e(3.1) to e(3.2) in the area between effect intensity e1 and e2 of FIG. 5 as follows:

$$\text{For all } f \geq 0 \text{ and } f \leq 0.5\text{: } e1' = e1 \quad [1]$$

$$e2' = e1 + (e2 - e1) * 2 * f \quad [2]$$

$$\text{For all } f > 0.5 \text{ and } f \leq 1\text{: } e1' = e1 + (e2 - e1) * (f - 0.5) * 2 \quad [3]$$

$$e2' = e2 \quad [4]$$

In another embodiment, the scaling factor f may be used for adapting the distance effect functions e(3.1) to e(3.2) over the whole distance area from 0% (position of the listener L) to 100% (maximum distance) as follows:

$$\text{For all } f \geq 0 \text{ and } f \leq 0.5\text{: } e1' = e1 * 2 * f \quad [5]$$

$$e2' = e2 * 2 * f \quad [6]$$

$$\text{For all } f > 0.5 \text{ and } f \leq 1\text{: } e1' = e1 + (1 - e1) * (f - 0.5) * 2; \quad [7]$$

$$e2' = e2 + (1 - e2) * (f - 0.5) * 2 \quad [8]$$

The effect slider ES may be designed as a mechanical slider of the audio reproduction system 3 and/or a sound machine and/or a monitoring system. Alternatively, the effect slider ES may be designed as a computer-implemented slider on a screen. Furthermore, the audio reproduction system 3 may comprise a plurality of effect sliders ES.

Figure 12:
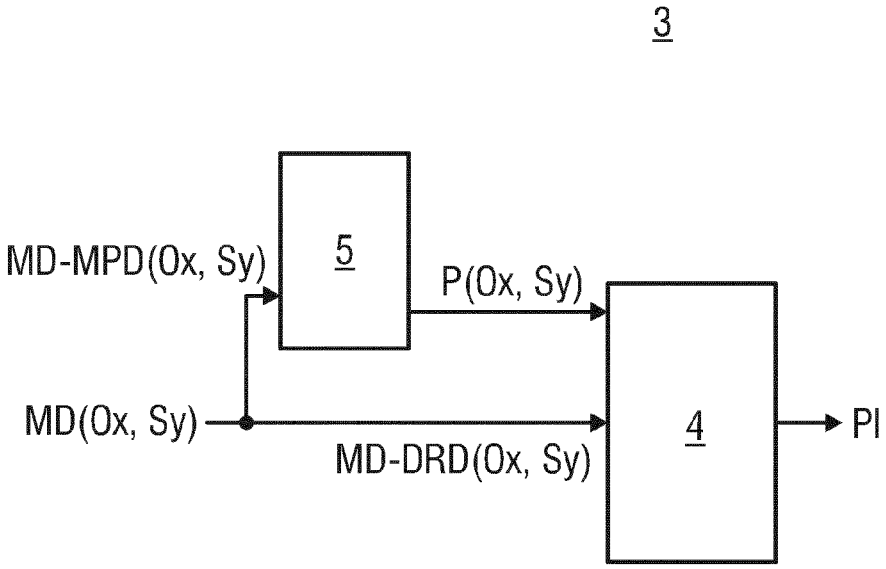
FIG. 12 shows another exemplary embodiment of an audio reproduction system with a panning information provider.

FIG. 12 shows another exemplary embodiment of an audio reproduction system 3 comprising a plurality of audio systems 3.1 to 3.4 and a panning information provider 4 and an adapter 5 adapted to amend at least one of the inputs IP1 to IP4.

As an example shown in FIG. 12, motion path data MPD may be used to determine the positions of an audio object Ox/sound source Sy along a motion path MP in an acoustic scene 2 to adapt their reproduction in the acoustic scene 2.

As it is shown in FIG. 12 for example the adapter 5 is fed with motion path data MPD of an audio object Ox and/or a sound source Sy in the acoustic scene 2 and/or in the environment 1 describing e.g. a given or random motion path MP with fixed and/or random positions/steps of the audio object Ox which shall be created by the audio systems 3.1 to 3.4 which are controlled by the adapted panning information PI.

The adapter 5 processes the motion path data MPD according to e.g. given fixed and/or random positions or a path function to adapt the position data P(Ox, Sy) which are fed to the panning information provider 4 which generates the adapted panning information PI, in particular the adapted parameter of the panning information PI.

Additionally, distance range data DRD, e.g. shape, distances r, angles of the audio ranges C0 to C1, T1, D1 to D2 may be fed to the panning information provider 4 to respectively process and consider them during generating of the panning information, e.g. by using simple logic and/or formulas and equations.

Figure 13:
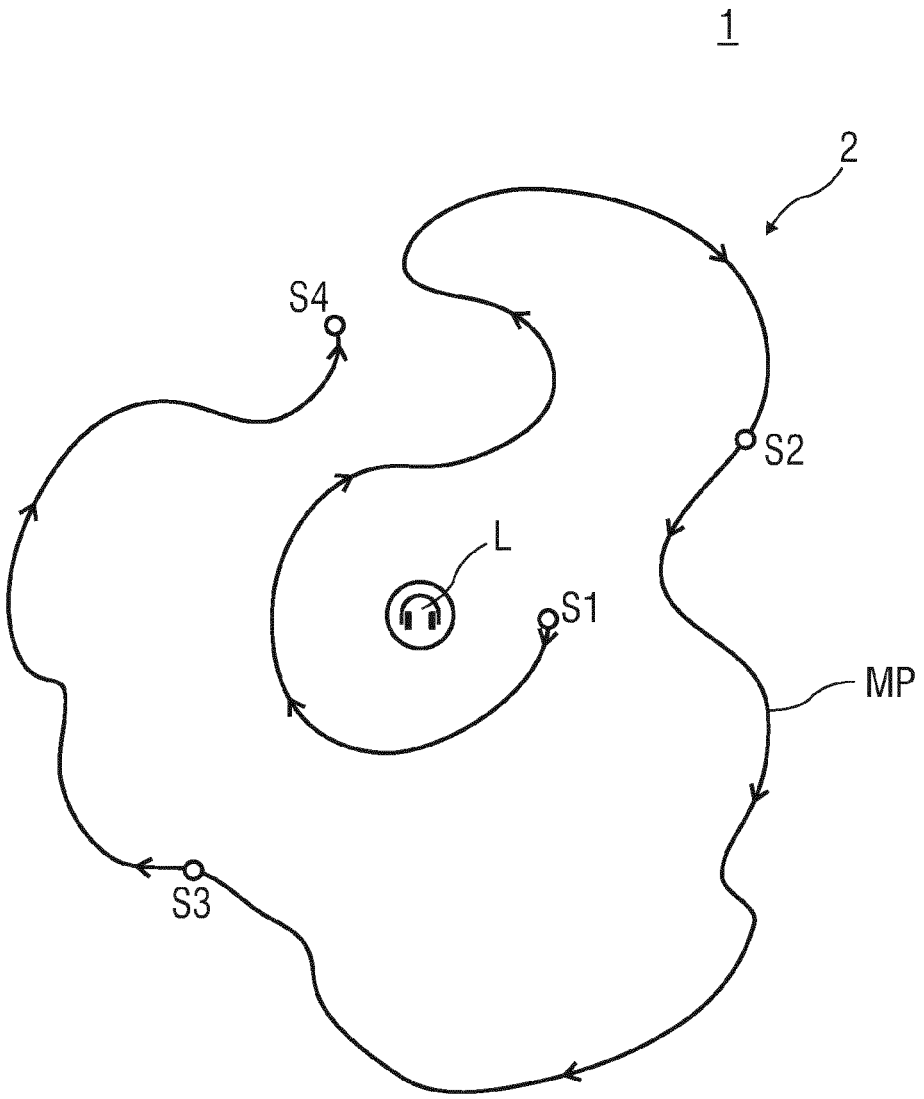
FIGS. 13 to 16 show exemplary embodiments of different acoustic scenes defined by fixed and/or variable positions of the audio object relative to the listener and/or by motion path with fixed and variable position of the audio object relative to the listener.

FIG. 13 shows a possible embodiment, in which instead of distance ranges an audio object Ox and/or a sound source Sy is movable along a motion path MP from step S1 to step S4 around the listener L. The motion path MP can be given by the motion path data MPD designed as an adapting function with respective positions of the audio object Ox/sound source Sy at the steps S1 to S4. The motion path MP describes a motion of the audio object Ox and/or the sound source Sy relative to the listener L or the environment 1 or the acoustic scene 2.

For example, an audio object Ox defined by object data OD as a bee or a noise can sound relative to the listener L and can follow the motion of the listener L according to motion path data MPD, too. The reproduction of the audio object Ox according to the motion path data MPD may be prioritized with respect to defined audio ranges C0 to C1, T1, D1 to D2. In other words: The reproduction of the audio object Ox based on motion path data MPD can be provided without or with using of the audio ranges C0 to C1, T1, D1 to D2. Such a reproduction enables immersive and 2D- and/or 3D live sound effects.

Figure 14:
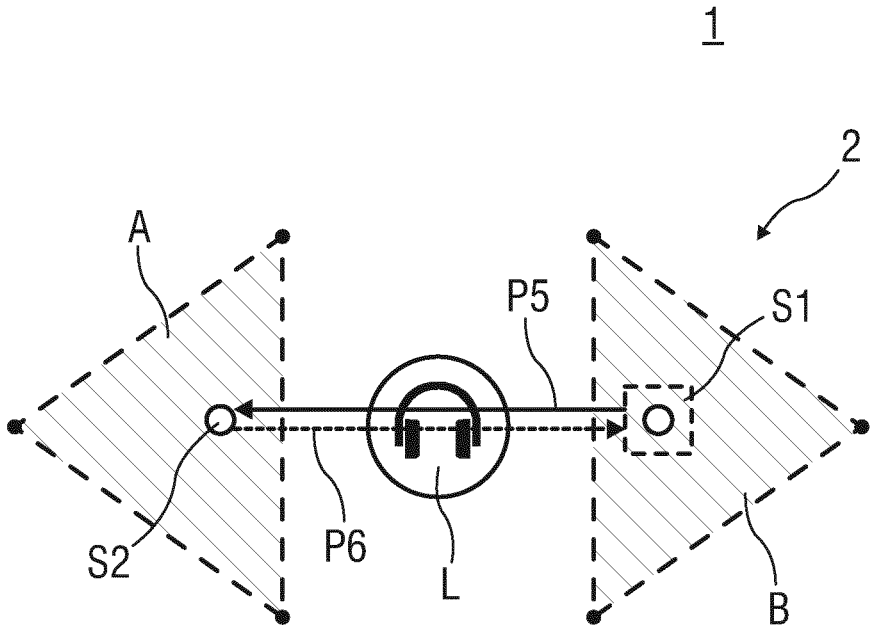

FIG. 14 shows another embodiment, in which instead of distance ranges random position areas A, B are used, wherein the shape of the random position areas A, B is designed as a triangle with random position or edges e.g. to reproduce footsteps, alternating between the left and right feet according to arrow P5 and P6. According to the sequence of footsteps a respective function determining fixed or random positions in the random position areas A, B can be adapted to drive the available reproducing audio systems.

Figure 15:
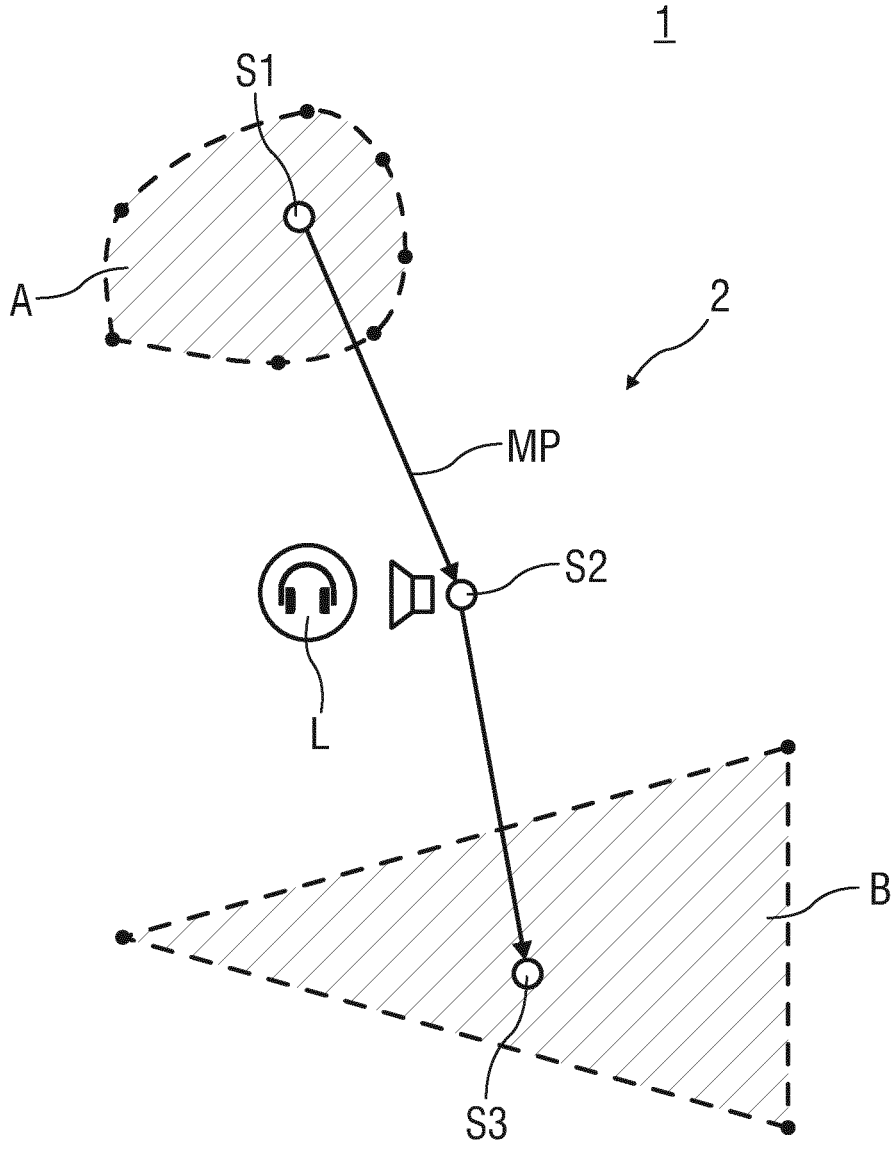

FIG. 15 shows another embodiment, in which instead of distance ranges random position areas A, B which position and shapes are changeable as well as a motion path MP are defined and used. For instance in an acoustic scene of a game ricochet, which moves from the frontside towards the backside of the listener L and passing the listener's right ear, are simulated by determining the position of the ricochet in the defined random position areas A, B along the motion path MP at the steps S1 to S3.

Figure 16:
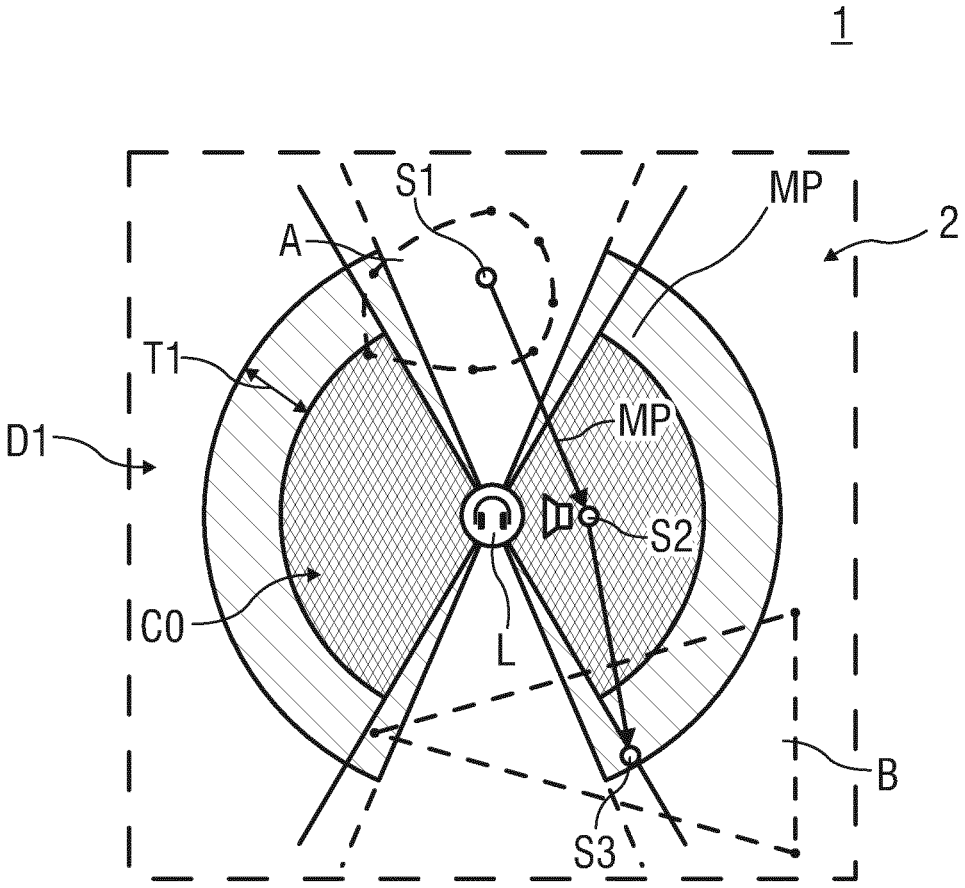

FIG. 16 shows an embodiment in which the embodiment of FIG. 15 with reproduction of the acoustic scene 2 using random position areas A, B and motion path data MPD is combined with the reproduction of the acoustic scene 2 using distance range data DRD comprising distance ranges C0, T1, D1. In addition to the close circular segments C0 and the distant segment D1 defined by distance range data DRD further random position areas A, B defined by random position area data and/or motion path data MPD of an audio object Ox and/or a sound source Sy are given to adapt the panning information PI which controls the acoustic systems 3.1, 3.2 to create the acoustic scene 2.

LIST OF REFERENCES

1 environment
2 acoustic scene

3 audio reproduction system
3.1 to 3.4 audio system
4 panning information provider
ES effect slider
A to B random position areas
DRD distance range data
C0 . . . Cm close range
CS configuration settings
D1 . . . Dn distant range
AD audio data
e1, e2 effect intensities
ES effect slider
I intensity
IP1 . . . IP5 inputs
e(3.1), e(3.2),
g0, h1 . . . hx, i0 distance effect functions
L listener
MD metadata
MP motion path
MPD motion path data
Ox audio object
P position data
PI panning information
P0 to P5 arrows
r1 to r5 distance
S1 to S4 steps
Sy sound source
T1 transfer range
Z circumferential structure
α angular position

The invention claimed is:

1. A method for reproducing audio data of at least one audio object and/or at least one sound source of an acoustic scene in a given environment by at least two audio systems acting distantly apart from each other comprising the following steps:

reproducing by one of the audio systems audio signals corresponding to the audio object and/or the sound source arranged in at least one first distance range to a listener and reproducing by another of the audio systems audio signals corresponding to the audio object and/or the sound source arranged in at least one second distant range to the listener, wherein the first and second distant ranges are different and possibly spaced apart from each other or placed adjacent to each other; and processing by a panning information provider of at least one input to generate at least one panning information for each audio system to differently drive the at least two audio systems, in particular to differently generate audio signals, wherein as an input a position data of the position of the audio object and/or of the sound source in the acoustic scene are provided; and wherein as the panning information at least one parameter, in particular a signal intensity and/or an angular position for the same audio object and/or the same sound source are generated for each audio system to differently drive the at least two audio systems, in particular to differently generate audio signals in such a manner that the same audio object and/or the same sound source is panned within at least one distance range and/or between two of the distance ranges of the audio systems; and wherein the panning information is determined by at least one given distance effect function which represents the distance effect functions of the respective audio object and/or the respective sound source in a transfer range between the at least two distance ranges of the audio systems and/or within one of the distance ranges.

2. The method according to claim 1, wherein as another input at least a metadata of the acoustic scene, of the environment, the audio object, the sound source and/or an effect slider are provided.

3. The method according to claim 2, wherein at least one parameter of the panning information, in particular the signal intensity and/or an angular position of the same audio object and/or the same sound source for the at least two audio systems, are extracted from the metadata and/or the configuration settings of the audio systems and/or the audio data.

4. The method according to claim 2, wherein the panning information are extracted from the metadata of the respective audio object and/or a time and/or a spot in the environment, in particular in a game scenario or in a room.

5. The method for reproducing audio data according to claim 1, wherein the audio data corresponds to interactive gaming scenarios, software scenarios, theatre scenarios, music scenarios, concert scenarios, movie scenarios, process monitoring scenarios and/or manufacturing scenarios.

6. The method according to claim 1, wherein the angular position of the same audio object and/or the same sound source for the at least two audio systems are equal.

7. A method for reproducing audio data of at least one audio object and/or at least one sound source of an acoustic scene in a given environment by at least two audio systems acting distantly apart from each other comprising the following steps:

reproducing by one of the audio systems audio signals corresponding to the audio object and/or the sound source arranged in at least one first distance range to a listener and reproducing by another of the audio systems audio signals corresponding to the audio object and/or the sound source arranged in at least one second distant range to the listener, wherein the first and second distant ranges are different and possibly spaced apart from each other or placed adjacent to each other; and processing by a panning information provider of at least one input to generate at least one panning information for each audio system to differently drive the at least two audio systems, in particular to differently generate audio signals, wherein as an input a position data of the position of the audio object and/or of the sound source in the acoustic scene are provided;

wherein as the panning information at least one parameter, in particular a signal intensity and/or an angular position for the same audio object and/or the same sound source are generated for each audio system to differently drive the at least two audio systems, in particular to differently generate audio signals in such a manner that the same audio object and/or the same sound source is panned within at least one distance range and/or between two of the distance ranges of the audio systems;

wherein as another input at least a metadata of the acoustic scene, of the environment, the audio object, the sound source and/or an effect slider are provided and wherein number and/or dimensions of the distant ranges and/or transfer ranges are extracted from the configuration settings, distance ranges definitions and/or from the metadata.

8. The method for reproducing audio data according to claim 7, wherein the audio data corresponds to interactive gaming scenarios, software scenarios, theatre scenarios, music scenarios, concert scenarios, movie scenarios, process monitoring scenarios and/or manufacturing scenarios.

9. A non-transitory computer-readable recording medium having a computer program for executing the method according to claim 7.

* * * * *